US005716219A

United States Patent [19]

Noike

[11] Patent Number: 5,716,219

[45] Date of Patent: Feb. 10, 1998

[54] ADAPTER FOR PLUG RECEPTACLE

[75] Inventor: Hiromi Noike, Nagano, Japan

[73] Assignee: Traveller House Co., Ltd., Nagano, Japan

[21] Appl. No.: 719,251

[22] Filed: Sep. 24, 1996

[30] Foreign Application Priority Data

Sep. 29, 1995 [JP] Japan ..... 7-276757
Apr. 19, 1996 [JP] Japan ..... 8-122746

[51] Int. Cl.[6] ..... H01R 39/00

[52] U.S. Cl. ..... 439/31; 439/173; 439/651

[58] Field of Search ..... 439/11, 31, 117, 439/171, 173, 174, 221, 222, 269.2, 640, 651, 956

[56] References Cited

U.S. PATENT DOCUMENTS

| | | | |
|---|---|---|---|
| 3,938,068 | 2/1976 | Hagan | 439/956 |
| 4,856,999 | 8/1989 | Flohr | 439/171 |
| 5,626,495 | 5/1997 | Drewnicki | 439/222 |

FOREIGN PATENT DOCUMENTS

| | | | |
|---|---|---|---|
| 61-64086 | 4/1986 | Japan . | |
| 1-121274 | 8/1989 | Japan . | |
| 1-150388 | 10/1989 | Japan . | |
| 4-33280 | 4/1992 | Japan . | |
| 7600749 | 8/1976 | Netherlands | 439/221 |
| 0263208 | 12/1926 | United Kingdom | 439/31 |

*Primary Examiner*—Gary F. Paumen
*Assistant Examiner*—Katrina Davis
*Attorney, Agent, or Firm*—Price, Gess & Ubell

[57] ABSTRACT

An adapter for a plug receptacle provided with a pair of plug terminals is capable of being fitted in various kinds of plug receptacles. A pair of adapter bodies made of an insulating material are pivotally connected at a lower portion thereof to each other. The adapter bodies each have a plug terminal provided on a front end surface of a corresponding one thereof and adapted to be inserted into a corresponding one of power terminal holes of a plug receptacle. Also, one of the adapter bodies is provided with a pair of power terminal holes having terminal contacts for a plug receptacle received therein to permit plug terminals of an electrical appliance to be inserted therein. The adapter bodies are kept open to form a V-shape by an elastic force.

21 Claims, 5 Drawing Sheets

ADAPTER FOR PLUG RECEPTACLE

BACKGROUND OF THE INVENTION

1. Field of the Invention

This invention relates to an adapter for a plug receptacle, and more particularly to an adapter that can be accommodated or applied to various kinds of plug receptacles generally used in the various countries.

2. Description of Related Art

Plug receptacles and plugs fitted in the plug receptacles which are generally used in various countries are constructed in different manners. More specifically, plugs used in the world are generally classified into seven types including a continental type shown in FIG. 10, a European Community type shown in FIG. 11, an old British type shown in FIG. 12 or 13, a new British type shown in FIG. 14, an Oceanic type shown in FIG. 15 and an American type shown in FIG. 16. In FIGS. 10 to 16, reference characters 32*a* and 32*b* designate a pair of plug terminals, 32*c* is a ground terminal, and 32*d* is a ground terminal hole.

A plug used in Japan is of the American type shown in FIG. 16.

Of plug receptacles in which such various plugs are fitted, a plug receptacle provided with a ground terminal hole (not shown) is often constructed in such a manner that a pair of power terminal holes (not shown) each having a terminal contact for a plug receptacle received or arranged therein are each closed with a lid member (not shown), resulting in preventing electrical shock. In the plug receptacle of such a type, a ground terminal provided on the plug is inserted into the ground terminal hole of the plug receptacle, to thereby displace the lid member from each of the power terminal holes, so that a pair of plug terminals of the plug may be fitted in the power terminal holes.

In view of such a difference in construction among the plugs and plug receptacles used in various countries, when an electrical appliance manufactured in a certain or first country is to be used in a different or second country, it is generally practiced that an adapter which can be accommodated or applied to a plug receptacle used in the second country is fitted on the plug receptacle. Then, plug terminals of a plug attached to the electrical appliance are fitted in a pair of power terminal holes for a plug receptacle formed in the adapter, so that the electrical appliance in the first country may be electrically connected to the plug receptacle in the second country.

A plug receptacle adapter for this purpose is provided on a front end surface thereof with plug terminals, a ground terminal and/or a ground terminal hole of the same type as any one of the plugs shown in FIGS. 10 to 16. The thus-provided plug terminals and ground terminal of the adapter are fitted in power terminal holes of a plug receptacle used in any foreign country and a ground terminal hole thereof, respectively. Also, the ground terminal of the plug receptacle is fitted in the ground terminal hole of the adapter. Thus, the adapter is fitted in the plug receptacle used in any foreign country.

Also, the plug receptacle adapter is provided on a rear end surface thereof with a pair of power terminal holes for a plug receptacle which are adapted to permit the plug terminals of the plug attached to the electrical appliance to be fitted therein, so that the electrical appliance may be electrically connected through the adapter to the plug receptacle.

Unfortunately, in the prior art, it is demanded to provide seven or more kinds of adapters in correspondence to seven or more kinds of plug receptacles used in various countries. This causes a foreign traveler to carry a plurality of kinds of plug receptacle adapters depending on countries which the traveler is to visit. Also, the traveler, when an electrical appliance carried is to be actually used in one of the countries, is needed to select the required one of the plug receptacle adapters depending on the country.

SUMMARY OF THE INVENTION

The present invention has been made in view of the foregoing disadvantages of the prior art.

It is an object of the present invention to provide an adapter for a plug receptacle which is capable of being generally fitted in various kinds of plug receptacles used in various countries.

It is another object of the present invention to provide an adapter for a plug receptacle which is capable of being significantly simplified in construction.

It is a further object of the present invention to provide an adapter for a plug receptacle which is capable of being readily handled.

It is still another object of the present invention to provide an adapter for a plug receptacle which is capable of being handy to carry.

In accordance with the present invention, an adapter for a plug receptacle is provided. The adapter includes a pair of adapter bodies made of an insulating material, at least one of the adapter bodies being provided with a pair of power terminal holes for a plug receptacle, a shaft structure through which the adapter bodies are pivotally connected at a lower portion thereof to each other, a bias means for biasing the adapter bodies to be rendered open to form a substantially V-shape due to pivotal movement of the adapter bodies, a pair of plug terminals for a power supply each provided on a front end surface of an upper portion of a corresponding one of the adapter bodies so as to outwardly extend therefrom, a pair of terminal contacts for a plug receptacle each arranged in one of the power terminal holes, and a connection means for electrically connecting the plug terminals to the terminal contacts, respectively.

In the adapter thus constructed, the pair of adapter bodies kept open to form a substantially V-shape due to an elastic force of the bias means may be pivotally moved about the shaft against the bias means in a direction of being closed. Therefore, a distance between the pair of power plug terminals provided on the front end surface of the upper portion of the adapter bodies may be conformed to that between a pair of power terminal holes of any intended plug receptacle.

Then, the plug terminals may be inserted into the power terminal holes of the plug receptacle and pressedly fitted in terminal contacts arranged in the power terminal holes of the plug receptacle, respectively, resulting in being electrically connected thereto. Thus, the adapter may be fitted in the plug receptacle.

At this time, the bias means permits the adapter bodies to be pivotally moved about the shaft in a direction of being unfolded to form a V-like shape, so that the plug terminals of the adapter may be pressedly abutted against the terminal fitments of the plug receptacle. This results in the plug terminals being more positively electrically connected to the terminal contacts of the plug receptacle.

Then, power supply plug terminals of a plug attached to an electrical appliance intended may be inserted into the power terminal holes of the adapter body, followed by press-fitting of the plug terminals of the electrical appliance in the terminal contacts of the adapter body, leading to electrical connection between the plug terminals of the electrical appliance and the terminal contacts of the adapter bodies. Thus, the electrical appliance may be effectively electrically connected through the adapter of the present invention to the plug receptacle.

In a preferred embodiment of the present invention, the adapter further includes column members each arranged on the front end surface of a corresponding one of the adapter bodies so as to outwardly extend therefrom, wherein the plug terminals are each arranged so as to outwardly extend from a corresponding one of the column members.

Such construction permits the adapter to be suitably fitted in a plug receptacle, which permits a plug of the European Community type shown in FIG. 11 to be inserted therein in such a manner that the plug terminals of the adapter bodies are fitted in a pair of power terminal holes provided side by side on a bottom surface of a recess formed on an end surface of the plug receptacle while being deeply inserted into the recess through the column members without being abutted against a side wall of the plug receptacle surroundingly defining the recess. This permits the plug terminals of the adapter bodies to be positively inserted into the power terminal holes of the plug receptacle.

In a preferred embodiment of the present invention, the plug terminals are each formed with a shape like a round bar of about 4 mm in diameter.

Such construction of the adapter permits the plug terminals of the adapter to be smoothly inserted into a pair of power terminal holes of a plug receptacle used in any country which power terminal holes are typically formed with an inner diameter of about 4 mm or more. Also, this permits the plug terminals to exhibit mechanical strength sufficient to prevent bending thereof.

In a preferred embodiment of the present invention, the adapter further includes a subadapter including a subadapter body made of an insulating material. The subadapter body is provided on a front end surface thereof with a pair of plug terminals of the Oceanic type for a power supply. The plug terminals of the subadapter body are formed by arranging a pair of strip-like plate members on the front end surface of the subadapter body so as to define both oblique sides of a trapezoid. The subadapter body is provided on a rear end surface thereof with a pair of power terminal holes for a plug receptacle. The power terminal holes each have a terminal contacts for a plug receptacle received therein. The plug terminals of the subadapter body are electrically connected to the terminal contacts arranged in the power terminal holes of the subadapter body through a connection means.

Such construction permits the subadapter to be effectively applied to the situation that it is required to connect any intended electrical appliance to a plug receptacle of the Oceanic type in which a pair of power terminal holes are arranged in a manner to define both oblique sides of a trapezoid when the electrical appliance is not conformed to the plug receptacle. Thus, the plug terminals of the subadapter body may be inserted into the power terminal holes of the Oceanic type plug receptacle. Then, the plug terminals may be pressedly fitted in the terminal contacts received in the power terminal holes of the Oceanic type plug receptacle. Also, a pair of power plug terminals of the electrical appliance intended may be inserted in the power terminal holes on the rear end surface of the subadapter body. Then, the power plug terminals of the appliance thus inserted may be pressedly fitted in the terminal fitments received in the power terminal holes of the subadapter body and electrically connected through connection means to the plug terminals. Thus, the subadapter permits any desired electrical appliance to be connected to the plug receptacle of the Oceanic type in which the power terminal holes are arranged in a manner to define both oblique sides of a trapezoid when the appliance is not conformed to the plug.

In the present invention, the adapter may be applied to a plug receptacle formed with an earth terminal hole and a pair of power terminal holes which are selectively closed with a lid member. In this instance, the subadapter body may be provided with a push pin for displacing the lid member from the power terminal holes of the plug receptacle. Such construction permits the push pin to be forcedly inserted into the earth terminal hole of the plug receptacle to displace the lid member from the power terminal holes of the plug receptacle. Then, the plug terminals of the adapter bodies may be fitted in the power terminal holes of the plug receptacle.

Also, in a preferred embodiment of the present invention, the power terminal holes of the adapter may each be formed with a cylindrical configuration having a substantially trapezoid shape in cross section, the power terminal holes of the adapter may be arranged on the adapter body so as to be juxtaposed to each other and so that a top side of the trapezoid shape in cross section of each of the power terminal holes faces outside of the adapter body, and the terminal contacts received in the power terminal holes may each include a pair of raised side walls arranged in a manner to define both oblique sides of a trapezoid and be in conformity to the trapezoid shape of the cross section of each of the power terminal holes. Alternatively, the embodiment may be constructed in such a way that the power terminal holes of the subadapter body are each formed with a cylindrical configuration having a substantially trapezoid shape in cross section, the power terminal holes of the subadapter body are arranged on the subadapter body so as to be juxtaposed to each other and so that a top side of the trapezoid shape thereof faces outside of the subadapter body, and the terminal contacts received in the power terminal holes of the subadapter body each include a pair of raised side walls arranged in a manner to define both oblique sides of a trapezoid and be in conformity to the trapezoid shape in cross section of each of the power terminal holes of the subadapter body.

In the adapter thus constructed, plug terminals of a plug attached to an electrical appliance intended may be smoothly inserted into the power terminal holes of the adapter or subadapter which are formed with a substantially trapezoid shape. Then, the plug terminals are pressedly fitted in the terminal contacts arranged in the power terminal holes of the adapter or subadapter and then pressedly abutted against the raised walls of the terminal contacts, resulting in being electrically positively connected thereto.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference numerals designate like or corresponding parts throughout; wherein.

DETAILED DESCRIPTION OF THE PREFERRED EMBODIMENT

Figure 1:
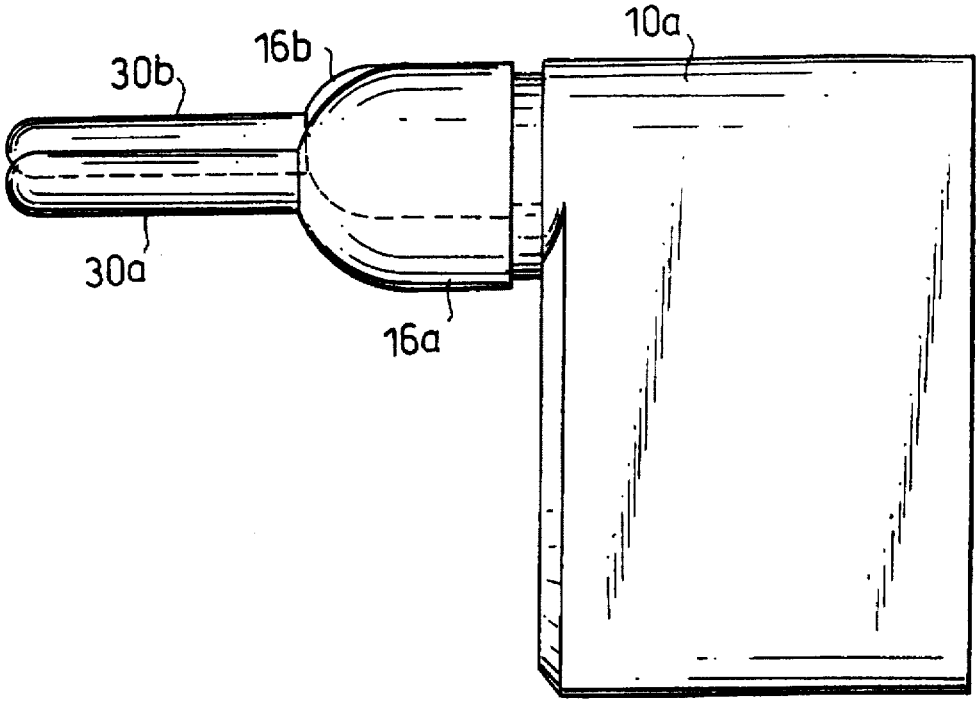
FIG. 1 is a side elevation view showing an embodiment of an adapter for a plug receptacle according to the present invention.

Now, an adapter for a plug receptacle according to the present invention will be described hereinafter with reference to the accompanying drawings.

Referring first to FIGS. 1 to 6, an embodiment of an adapter for a plug receptacle according to the present invention is illustrated. An adapter for a plug receptacle of the illustrated embodiment includes a pair of adapter bodies 10*a* and 10*b*, which may be formed of an insulating material such as a plastic material or the like with a rectangular parallelepiped configuration. The adapter bodies 10*a* and 10*b* are pivotally connected at a lower portion thereof to each other through shafts 20 and 22 (FIG. 5) in a manner to be pivotally moved to each other about the shafts 20 and 22. This results in the adapter bodies 10*a* and 10*b* being unfolded due to pivotal movement thereof about the shafts 20 and 22 to form a substantially V-shape therebetween.

More particularly, the shaft 20 is disposed on a rear portion of a lower section of one of the adapter bodies 10*a* and 10*b* so as to be projected therefrom. In the illustrated embodiment, the shaft 20 is located on the adapter body 10*a*. Also, the shaft 22 is arranged in a member 28 fitted in a front portion of the lower section of the one adapter body 10*a*. The other adapter body 10*b* is formed on a lower section thereof with a bearing member 24 of a cylindrical shape which is laterally projected therefrom. The shafts 20 and 22 thus arranged are pivotally inserted into the bearing member 24 from rear and front end sides of the member 24, respectively. The shafts 20 and 22 are integrally joined to each other in the bearing member 24 by means of a set screw 26, to keep them from being removed from the bearing member 24. The adapter bodies 10*a* and 10*b* are provided with a stopper mechanism (not shown), which functions to prevent a substantially V-shape defined between the adapter bodies due to pivotal movement thereof about the shafts 20 and 22 from exceeding a predetermined angle.

Figure 2:
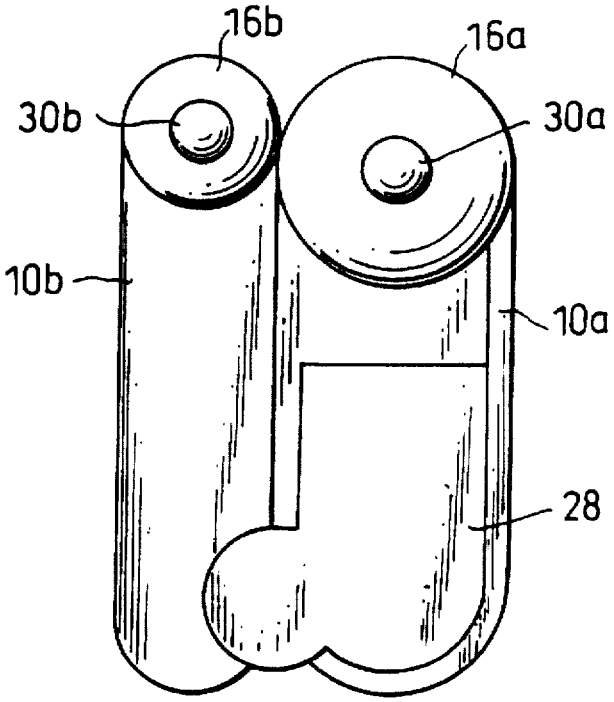
FIG. 2 is a front end view of the adapter shown in FIG. 1.

The adapter bodies 10*a* and 10*b*, as shown in FIGS. 1 and 2, are provided on a front end surface of an upper section thereof with a pair of plug terminals 30*a* and 30*b* for a power supply, respectively. The plug terminals 30*a* and 30*b* may be made of a conductive material such as copper or the like. The plug terminals 30*a* and 30*b* are embedded at a rear end thereof in the adapter bodies 10*a* and 10*b*, respectively.

In the illustrated embodiment, the plug terminals 30*a* and 30*b* may be formed with a shape like a round bar of about 4 mm in diameter, resulting in being smoothly inserted into a pair of power terminal holes of a plug receptacle used in any country which are formed with an inner diameter of about 4 mm or more. Also, the plug terminals 30*a* and 30*b* may be constructed so as to exhibit mechanical strength sufficient to prevent bending thereof.

The plug terminals 30*a* and 30*b* are mounted through column members 16*a* and 16*b* provided on the above-described front end surface of the upper section of the adapter bodies 10*a* and 10*b* on the adapter bodies 10*a* and 10*b* in a manner to forwardly extend therefrom, respectively. The column members 16*a* and 16*b* are made of an insulating material such as plastic or the like and arranged so as to forwardly extend over a length of about 16 mm from the front end surface of the upper section of the adapter bodies 10*a* and 10*b*, respectively. The plug terminals 30*a* and 30*b* are arranged so as to be projected from a distal end of the column members 16*a* and 16*b* thus provided.

Figure 11:
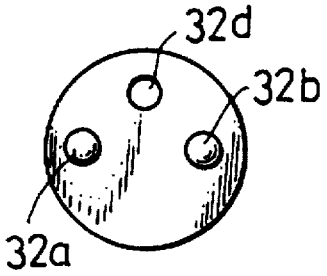
FIG. 11 is a front end view showing a plug of the European Community type.
Figure 12:
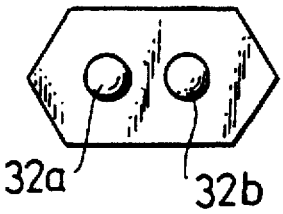
FIG. 12 is a front end view showing a plug of the old British type.
Figure 13:
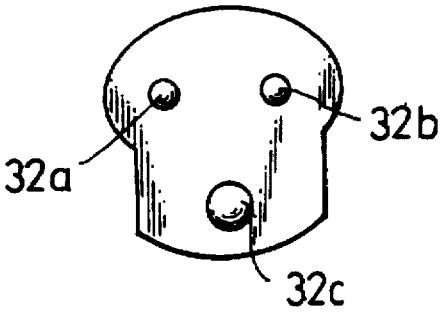
FIG. 13 is a front end view showing a plug of the old British type.

The adapter of the illustrated embodiment may be suitably fitted in a plug receptacle which permits a plug of the European Community type shown in FIG. 11 to be inserted therein in such a manner that the plug terminals 30*a* and 30*b* of the adapter bodies 10*a* and 10*b* are fitted in a pair of power terminal holes provided side by side on a bottom surface of a recess formed on an end surface of the plug receptacle while being deeply inserted into the recess through the column members 16*a* and 16*b* without being abutted against a side wall of the plug receptacle having a height of about 15 mm and surroundingly defining the recess. This results in the plug terminals 30*a* and 30*b* of the adapter bodies 10*a* and 10*b* being positively inserted into the power terminal holes of the plug receptacle.

Figure 3:
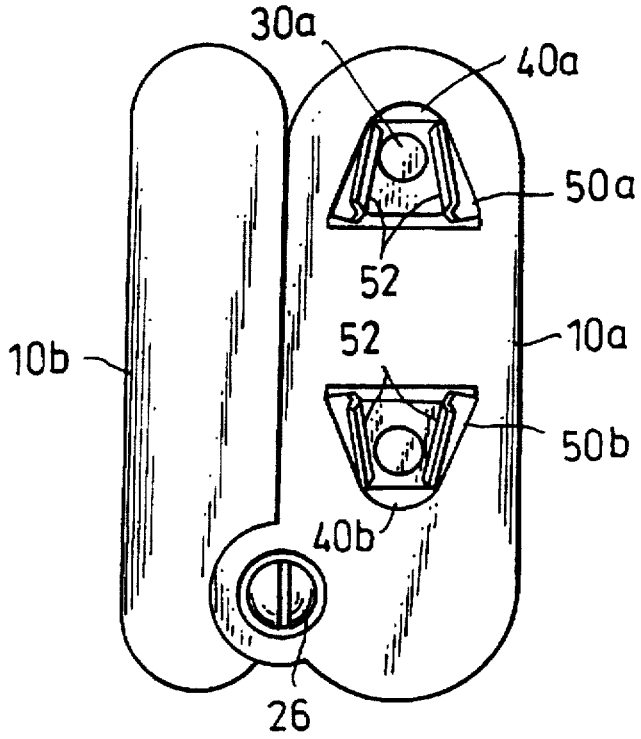
FIG. 3 is a rear end view of the adapter shown in FIG. 1.

Also, the one adapter body 10*a*, as shown in FIG. 3, is provided on a rear end surface thereof with a pair of power terminal holes 40*a* and 40*b* for a plug receptacle in a manner to be vertically juxtaposed to each other.

The power terminal holes 40*a* and 40*b* are each formed with a cylindrical configuration having a substantially trapezoid shape in cross section. Also, the power terminal holes 40*a* and 40*b* of the adapter body 10*a* are arranged so as to be juxtaposed to each other in a vertical direction and so that a top side of the trapezoid faces outside of the adapter body 10*a* in the vertical direction as shown in FIG. 3.

Figure 14:
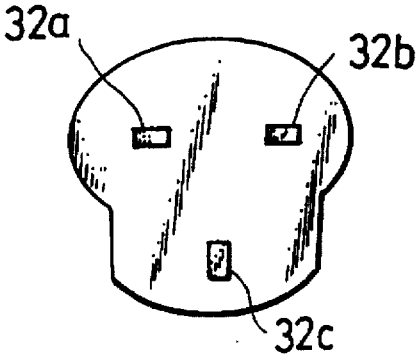
FIG. 14 is a front end view showing a plug of the new British type.
Figure 15:
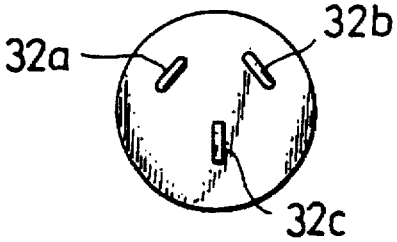
FIG. 15 is a front end view showing a plug of the Oceanic type.
Figure 16:
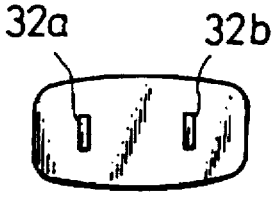
FIG. 16 is a front end view showing a plug of the American type.

The power terminal holes 40*a* and 40*b* are provided therein with terminal contacts 50*a* and 50*b* for a plug receptacle, respectively, which are made of a conductive material such as copper or the like. The terminal contacts 50*a* and 50*b* each include a pair of raised walls 52 arranged so as to extend along both raised side walls of a corresponding one of the power terminal holes 40*a* and 40*b* opposite to each other which side walls define both oblique sides of a trapezoid. Thus, the raised walls 52 in each pair are likewise arranged in a manner to define both oblique sides of a trapezoid. The power terminal holes 40*a* and 40*b* of the adapter body 10*a* permit a pair of power plug terminals which are provided on each of plugs of the continental type, European Community type, old British type, Oceanic type and the like as shown in FIGS. 10 to 13, 15 and 16 other than that of the new British type shown in FIG. 14 to be formed with a suitable shape such as a strip-like shape, a round bar-like shape or the like. The power plug terminals can be inserted into the power terminal holes 40*a* and 40*b*, to thereby be pressedly abutted against the raised walls 52 of the terminal contacts 50*a* and 50*b* arranged in the power terminal holes 40*a* and 40*b*. This permits the power plug terminals of the plug to be electrically connected to the terminal contacts 50*a* and 50*b* received in the power terminal holes 40*a* and 40*b* of the adapter body 10*a*.

Thus, the adapter of the illustrated embodiment is so constructed that the terminal contacts 50*a* and 50*b* for a plug receptacle each including the raised walls 52 arranged so as to form both oblique sides of a trapezoid are received in the power terminal holes 40*a* and 40*b* formed with a cylindrical configuration having a trapezoid shape in cross section. Such construction permits plugs used in various countries to be fitted in the adapter of the illustrated embodiment. Thus, the adapter of the illustrated embodiment can be referred to as a "common type adapter".

The terminal contacts 50*a* and 50*b* are electrically connected, directly or through a connection means 60, with the plug terminals 30*a* and 30*b* arranged on the front end surface of the upper section of the adapter bodies 10*a* and 10*b*, respectively.

Figure 5:
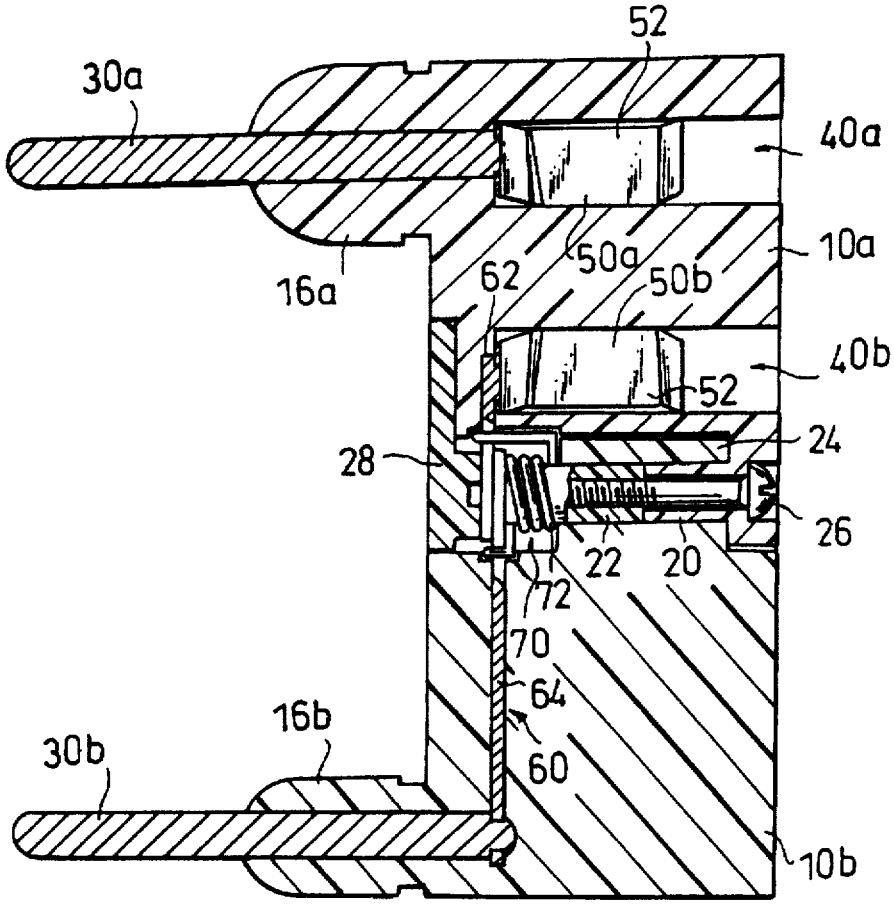
FIG. 5 is a sectional view taken along line V—V of FIG. 4.
Figure 6:
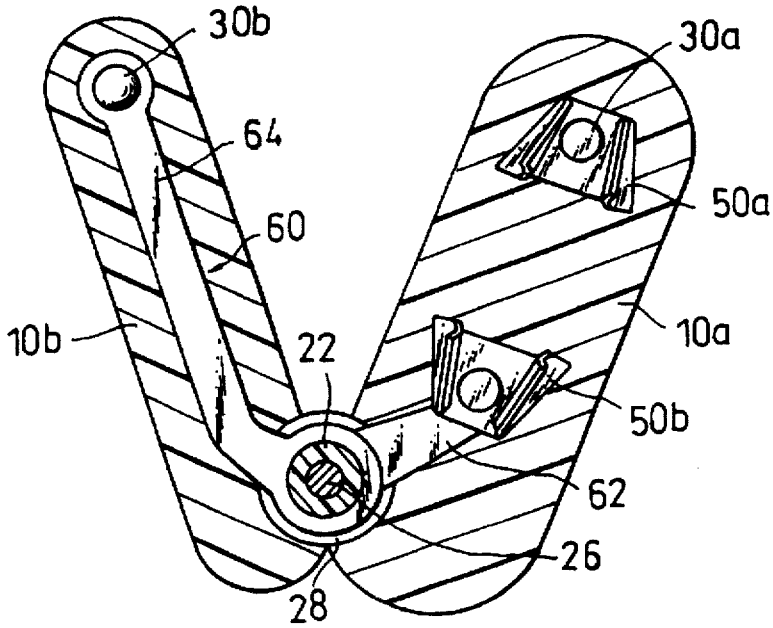
FIG. 6 is a vertical cross-sectional view showing a connection means incorporated in the adapter shown in FIG. 1.

More particularly, the connection means 60, as shown in FIGS. 5 and 6, includes a first connection arm 62 and a second connection arm 64 made of a conductive material such as copper or the like having a strip-like shape and embedded in the adapter bodies 10*a* and 10*b*, respectively. Thus, the terminal contact 50*b* for a plug receptacle received in the power terminal hole 40*b* formed at a lower portion of the rear end surface of the one adapter body 10*a* is electrically connected through the thus-arranged first connection arm 62 and second connection arm 64 of the connection means 60 to the plug terminal 30*b* provided on the front end surface of the upper portion of the other adapter body 10*b*. The first connection arm 62 is connected at one end thereof to the terminal contact 50*b* and the second connection arm 64 is connected at one end thereof to the plug terminal 30*b*. Also, the first connection arm 62 and second connection arm 64 are fitted at the other end thereof on the shaft 22 while being positioned adjacently to each other, as shown in FIGS. 5 and 6. Further, the first connection arm 62 and second connection arm 64 are kept in a slidable contact at the other end thereof with each other while being urged in an axial direction of the shaft 22 by an elastic force of a coiled spring 72 fitted on the shaft 22, resulting in electrical connection between the arms 62 and 64 being established. In addition, the terminal contact 50*a* arranged in the power terminal hole 40*a* formed at the upper portion of the rear end surface of the adapter body 10*a* is connected to a rear end of the plug terminal 30*a* arranged so as to extend at a front end thereof from the front end surface of the upper portion of the adapter body 10*a*.

The coiled spring 72 briefly described above, as shown in FIG. 5, is loosely fitted on the shaft 22 through which the adapter bodies 10*a* and 10*b* are pivotally connected at the lower portion thereof to each other. The coiled spring 72 is held at one end and the other end thereof on one side edge of the first connection arm 62 and that of the second connection arm 64, respectively. Thus, an elastic force of the coiled spring 72 in a circumferential direction of the shaft 22 results in the adapter bodies 10*a* and 10*b* in which the first connection arm 62 and second connection arm 64 are respectively partially embedded being pivotally moved about the shafts 20 and 22 in a direction of being separated from each other, so that the adapter bodies 10*a* and 10*b* may be opened to form a substantially V-shape. Thus, the coiled spring 72 provides a bias means 70 which acts to pivotally move the adapter bodies 10*a* and 10*b* about the shafts 20 and 22 by the elastic force thereof to unfold them to form a substantially V-shape.

Now, the manner of operation and use of the adapter of the illustrated embodiment thus constructed will be described hereinafter.

Figure 4:
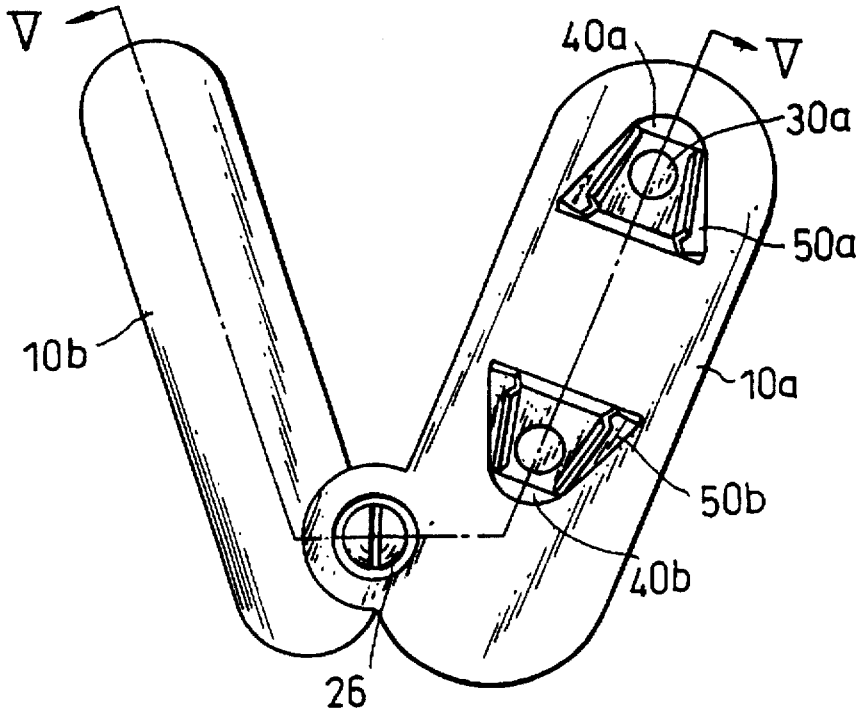
FIG. 4 is a rear end view of the adapter shown in FIG. 1 wherein an adapter body is unfolded to form a V-like shape.

Prior to use of the adapter, the adapter bodies 10*a* and 10*b* are rendered open to form a V-like shape due to the elastic force of the bias means 70, as shown in FIG. 4. Then, when an intended electrical appliance is not conformed directly to a plug receptacle, therefore, the adapter of the illustrated embodiment is to be applied to the plug receptacle to electrically connect the electrical appliance to the plug receptacle through the adapter; the adapter bodies 10*a* and 10*b* are pivotally moved about the shafts 20 and 22 against the elastic force of the bias means 70, to thereby be closed to a predetermined angle. This results in a distance between the plug terminals 30*a* and 30*b* which are provided on the front end surface of the upper section of the adapter bodies 10*a* and 10*b* to coincide with the power terminal holes (not shown) of the plug receptacle.

Then, the plug terminals 30*a* and 30*b* are inserted into the power terminal holes of the plug receptacle and pressedly fitted in terminal contacts (not shown) arranged in the power terminal holes of the plug receptacle, to thereby be electrically connected. Thus, the adapter of the illustrated embodiment is fitted on the plug receptacle.

Subsequently, the bias means 70 causes the adapter bodies 10*a* and 10*b* to be pivotally moved about the shafts 20 and 22 in directions opposite to each other, to thereby be rendered open with respect to each other, so that the plug terminals 30*a* and 30*b* of the adapter bodies 10*a* and 10*b* may be pressedly abutted against the terminal contacts of the plug receptacle. This permits the plug terminals 30*a* and 30*b* to be more positively electrically connected to the terminal contacts of the plug receptacle.

Then, a plug attached to the electric appliance which is to be electrically connected through the adapter to the plug receptacle is fitted in the adapter. More particularly, a pair of power plug terminals (not shown) of the plug are inserted into the power terminal holes 40*a* and 40*b* provided on the rear end surface of the adapter body 10*a*. Then, the plug terminals of the plug are pressedly fitted in the terminal contacts 50*a* and 50*b* of the power terminal holes 40*a* and 40*b* of the adapter body 10*a*, to thereby be electrically connected to the terminal contacts 50*a* and 50*b*.

Thus, it will be noted that the adapter of the illustrated embodiment permits any intended electrical appliance to be electrically connected therethrough to a plug receptacle when the electrical appliance is not conformed directly to the plug receptacle.

Figure 7:
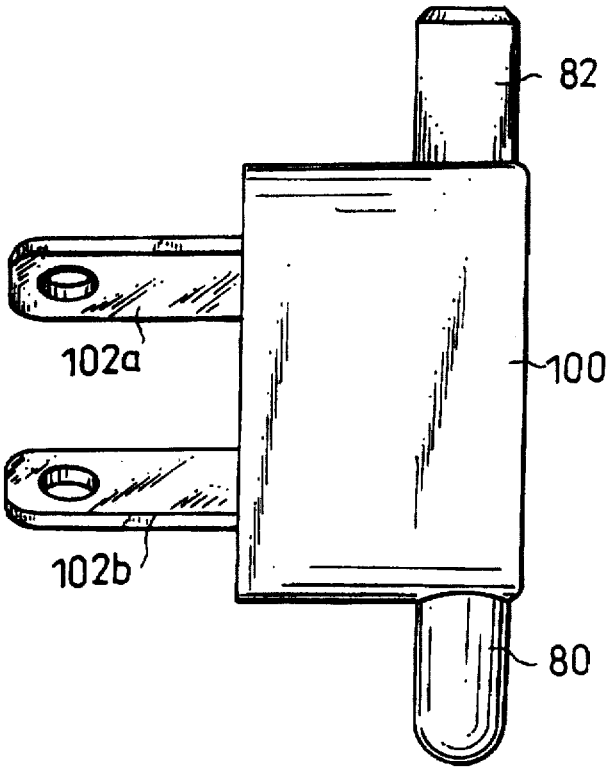
FIG. 7 is a side elevation view showing a subadapter for an adapter of the present invention.
Figure 8:
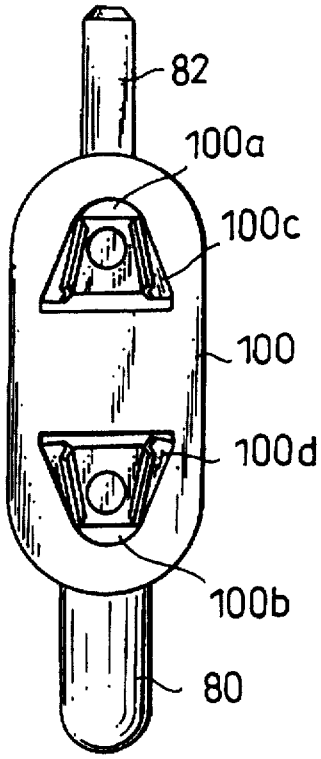
FIG. 8 is a rear end view of the subadapter shown in FIG. 7.
Figure 9:
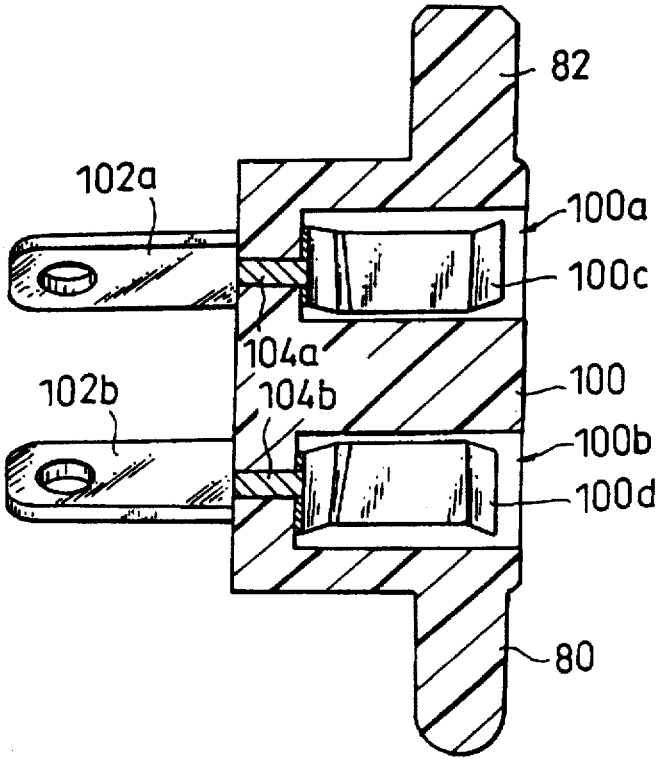
FIG. 9 is a side elevation view in section showing a connection means incorporated in the subadapter shown in FIG. 7.
Figure 10:
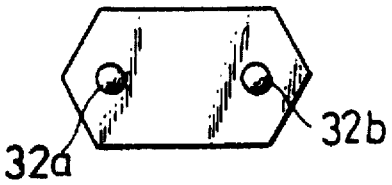
FIG. 10 is a front end view showing a plug of the continental type.

The adapter of the illustrated embodiment may further include a subadapter which may be constructed in such a manner as shown in FIGS. 7 to 9. More particularly, the subadapter includes a subadapter body 100 made of an insulating material such as plastic or the like. The subadapter body 100 is provided on a front end surface thereof with a pair of plug terminals 102*a* and 102*b* for a power supply of the Oceanic type. The plug terminals 102*a* and 102*b* are arranged in a manner to forwardly extend therefrom while defining both oblique sides of a trapezoid. Also, the subadapter body 100 is formed on a rear end surface thereof with a pair of power terminal holes 100*a* and 100*b* which have a pair of terminal contacts 100*c* and 100*d* for a plug receptacle received therein, respectively. The plug terminals 102*a* and 102*b*, as shown in FIG. 9, are electrically connected to the terminal contacts 100*c* and 100*d* through connection means 104*a* and 104*b* embedded in the subadapter body 100, respectively. The connection means 104*a* and 104*b* each may be formed of a conductive material such as copper or the like with a suitable shape like a rod-like shape or the like.

The subadapter thus constructed may be effectively applied to the situation that it is required to connect any intended electrical appliance to a plug receptacle of the Oceanic type in which a pair of power terminal holes are arranged in a manner to define both oblique sides of a trapezoid when the electrical appliance is not conformed directly to the plug receptacle. More particularly, the plug terminals 102*a* and 102*b* of the subadapter body 100 are inserted into the power terminal holes of the Oceanic type plug receptacle. Then, the plug terminals 102*a* and 102*b* are pressedly fitted in the terminal fitments received in the power terminal holes of the Oceanic type plug receptacle. Also, a pair of power plug terminals of the electrical appliance intended are inserted in the power terminal holes 100*a* and 100*b* on the rear end surface of the subadapter body 100. Then, the power plug terminals of the appliance thus inserted are pressedly fitted in the terminal fitments 100*c* and 100*d* received in the power terminal holes 100*a* and 100*b* of the subadapter body 100 and electrically connected through connection means 104*a* and 104*b* to the plug terminals 102*a* and 102*b*.

Thus, it will be noted that the subadapter permits any desired electrical appliance to be connected to a plug receptacle of the Oceanic type in which the power terminal holes are arranged in a manner to define both oblique sides of a trapezoid when the appliance is not conformed directly to the plug.

The subadapter body 100 of the subadapter may include a displacement means which is forcedly inserted in a circular or rectangular ground terminal hole of a plug receptacle to displace a lid member provided on the plug receptacle for closing each of a pair of power terminal holes of the plug receptacle from the power terminal holes. The displacement means, as shown in FIGS. 7 and 8, may comprise a push pin 80 like a round bar or a push pin 82 like a rectangular bar.

Now, the manner of operation of the subadapter for will be described hereinafter. First, the round or rectangular push pin 80 or 82 is forcedly inserted into the circular or rectangular ground terminal hole of the plug receptacle to displace the lid member from each of the power terminal holes of the plug receptacle. Then, the plug terminals 30*a* and 30*b* of the adapter bodies 10*a* and 10*b* are fitted in the power terminal holes of the plug receptacle.

In the adapter of the illustrated embodiment, the plug terminals 30*a* and 30*b* may each be formed with a round bar-like shape as described above, a strip-like shape of a reduced width, a triangle pole-like shape of a reduced sectional area, a polygonal pole-like shape such as a rectangular pole-like shape or the like, depending on a configuration of the power terminal holes of a plug receptacle to which the adapter of the illustrated embodiment is to be applied.

Further, when the adapter of the illustrated embodiment is to be exclusively applied to any desired plug receptacle other than a plug receptacle of the European Community Type projectedly provided with a side wall, the plug terminals 30*a* and 30*b* may be arranged directly on the front end surface of the adapter bodies 10*a* and 10*b* without interposedly arranging the column members 16*a* and 16*b* therebetween. Then, the pair of plug terminals 30*a* and 30*b* are fitted in power terminal holes of the plug receptacle.

Also, when the adapter and subadapter of the present invention described above are exclusively applied to electrical connection of an electrical appliance equipped with a plug of the American type to any desired plug receptacle, the pair of power terminal holes 40*a* and 40*b* provided on the rear end surface of the adapter body 10*a* and having the terminal contacts 50*a* and 50*b* received therein or the pair of power terminal holes 100*a* and 100*b* provided on the rear end surface of the subadapter body 100 and having the terminal contacts 100*c* and 100*d* received therein may be arranged in parallel in a longitudinal direction thereof so as to juxtaposed to each other while being formed with a strip-like shape, to thereby be conformed to the American type plug. Then, a pair of plug terminals of the American type plug are fitted in the power terminal holes 40*a*, 40*b* or 100*a*, 100*b*.

The adapter of the illustrated embodiment may be so constructed that the pair of power terminal holes 40*a* and 40*b* having the terminal contacts 50*a* and 50*b* for a plug receptacle arranged therein may be provided on either the other adapter body 10*b* in place of the one adapter body 10*a* or both adapter bodies 10*a* and 10*b*, when the adapter has a sufficient space. Similarly, they may be provided on a side surface of one of the adapter bodies 10*a* and 10*b*.

As can be seen from the foregoing, the adapter of the present invention permits a distance between the pair of plug terminals provided on the pair of adapter bodies to be conformed to that between power terminal holes of any desired plug receptacle, so that the plug terminals may be satisfactorily inserted into the power terminal holes. Then, the plug terminals are pressedly fitted in terminal contacts for a plug receptacle arranged in the power terminal holes, resulting in being electrically connected to the terminal contacts. Thus, the adapter of the present invention may be fitted on any desired plug receptacle.

Also, in the adapter of the present invention, the bias means permits the pair of plug terminals to be pressedly abutted against the terminal contacts arranged in the power terminal holes, resulting in electrical connection between the plug terminals and the terminal contacts being more positively carried out.

Further, the adapter of the present invention permits a pair of power plug terminals of a plug which is attached to an intended electrical appliance to be inserted into the power terminal holes of the adapter body. Then, the pair of plug terminals of the plug are pressedly fitted in the terminal contacts arranged in the power terminal holes of the adapter body, to thereby be electrically connected to the terminal contacts of the adapter. Thus, the electrical appliance may be electrically connected through the adapter of the present invention to any desired plug receptacle when the appliance is not conformed to the plug receptacle.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An adapter for a plug receptacle, comprising:

a pair of adapter bodies made of an insulating material, at least one of said adapter bodies being provided with a pair of power terminal holes for a plug receptacle;

a shaft structure through which said adapter bodies are pivotally connected at a lower portion thereof to each other;

a bias means for biasing said adapter bodies to be rendered open to form a substantially V-shape due to pivotal movement of said adapter bodies;

a pair of plug terminals for a power supply each provided on a front end surface of an upper portion of a corresponding one of said adapter bodies so as to outwardly extend therefrom;

a pair of terminal contacts for a plug receptacle each arranged in one of said power terminal holes; and a connection means for electrically connecting said plug terminals to said terminal contacts, respectively.

2. An adapter as defined in claim 1, further comprising column members each arranged on said front end surface of a corresponding one of said adapter bodies so as to outwardly extend therefrom;

said plug terminals being each arranged so as to outwardly extend from a corresponding one of said column members.

3. An adapter as defined in claim 1, wherein said plug terminals are each formed with a shape like a round bar of about 4 mm in diameter.

4. An adapter as defined in claim 2, wherein said plug terminals are each formed with a shape like a round bar of about 4 mm in diameter.

5. An adapter as defined in claim 1, wherein said power terminal holes are each formed with a cylindrical configuration having a substantially trapezoid shape in cross section;

said power terminal holes are arranged on said adapter body so as to be juxtaposed to each other and so that a top side of the trapezoid shape in cross section of each of said power terminal holes faces outside of said adapter body; and said terminal contacts received in said power terminal holes each include a pair of raised side walls arranged in a manner to define both oblique sides of a trapezoid and to be in conformity to the trapezoid shape in cross section of each of said power terminal holes.

6. An adapter as defined in claim 2, wherein said power terminal holes are each formed with a cylindrical configuration having a substantially trapezoid shape in cross section;

said power terminal holes are arranged on said adapter body so as to be juxtaposed to each other and so that a top side of the trapezoid shape in cross section of each of said power terminal holes faces outside of said adapter body; and said terminal contacts received in said power terminal holes each include a pair of raised side walls arranged in a manner to define both oblique sides of a trapezoid and to be in conformity to the trapezoid shape in cross section of each of said power terminal holes.

7. An adapter as defined in claim 3, wherein said power terminal holes are each formed with a cylindrical configuration having a substantially trapezoid shape in cross section;

said power terminal holes are arranged on said adapter body so as to be juxtaposed to each other and so that a top side of the trapezoid shape in cross section of each of said power terminal holes faces outside of said adapter body; and said terminal contacts received in said power terminal holes each include a pair of raised side walls arranged in a manner to define both oblique sides of a trapezoid and to be in conformity to the trapezoid shape in cross section of each of said power terminal holes.

8. An adapter as defined in claim 4, wherein said power terminal holes are each formed with a cylindrical configuration having a substantially trapezoid shape in cross section;

said power terminal holes are arranged on said adapter body so as to be juxtaposed to each other and so that a top side of the trapezoid shape in cross section of each of said power terminal holes faces outside of said adapter body; and said terminal contacts received in said power terminal holes each include a pair of raised side walls arranged in a manner to define both oblique sides of a trapezoid and to be in conformity to the trapezoid shape in cross section of each of said power terminal holes.

9. An adapter as defined in claim 1, further comprising a subadapter including a subadapter body made of an insulating material;

said subadapter body being provided on a front end surface thereof with a pair of second plug terminals of an Oceanic type for a power supply, said second plug terminals being formed by arranging a pair of strip-like plate members on said front end surface of said subadapter body so as to define both oblique sides of a trapezoid;

said subadapter body being provided on a rear end surface thereof with a pair of second power terminal holes for a plug receptacle, said second power terminal holes each having a second terminal contact for a plug receptacle received therein;

said second plug terminals being electrically connected to the respective second terminal contacts arranged in said second power terminal holes of said subadapter body through a second connection means.

10. An adapter as defined in claim 3, further comprising a subadapter including a subadapter body made of an insulating material;

said subadapter body being provided on a front end surface thereof with a pair of second plug terminals of an Oceanic type for a power supply, said second plug terminals being formed by arranging a pair of strip-like plate members on said front end surface of said subadapter body so as to define both oblique sides of a trapezoid;

said subadapter body being provided on a rear end surface thereof with a pair of second power terminal holes for a plug receptacle, said second power terminal holes each having a second terminal contact for a plug receptacle received therein;

said second plug terminals being electrically connected to the respective second terminal contacts arranged in said second power terminal holes of said subadapter body through a second connection means.

11. An adapter as defined in claim 5, further comprising a subadapter including a subadapter body made of an insulating material;

said subadapter body being provided on a front end surface thereof with a pair of second plug terminals of an Oceanic type for a power supply, said second plug terminals being formed by arranging a pair of strip-like plate members on said front end surface of said subadapter body so as to define both oblique sides of a trapezoid;

said subadapter body being provided on a rear end surface thereof with a pair of second power terminal holes for a plug receptacle, said second power terminal holes each having a second terminal contact for a plug receptacle received therein;

said second plug terminals being electrically connected to the respective second terminal contacts arranged in said second power terminal holes of said subadapter body through a second connection means.

12. An adapter as defined in claim 7, further comprising a subadapter including a subadapter body made of an insulating material;

said subadapter body being provided on a front end surface thereof with a pair of second plug terminals of an Oceanic type for a power supply, said second plug terminals being formed by arranging a pair of strip-like plate members on said front end surface of said subadapter body so as to define both oblique sides of a trapezoid;

said subadapter body being provided on a rear end surface thereof with a pair of second power terminal holes for a plug receptacle, said second power terminal holes each having a second terminal contact for a plug receptacle received therein;

said second plug terminals being electrically connected to the respective second terminal contacts arranged in said second power terminal holes of said subadapter body through a second connection means.

13. An adapter as defined in claim 10, wherein said subadapter body is provided with a push pin so that when the adapter is applied to a plug receptacle which is formed with a ground terminal hole and provided with a pair of power terminal holes which are selectively closed with a lid member, said push pin displaces said lid member from said power terminal holes of the plug receptacle.

14. An adapter as defined in claim 10, wherein said subadapter body is provided with a push pin so that when the adapter is applied to a plug receptacle which is formed with a ground terminal hole and provided with a pair of power terminal holes which are selectively closed with a lid member, said push pin displaces said lid member from said power terminal holes of the plug receptacle.

15. An adapter as defined in claim 11, wherein said subadapter body is provided with a push pin so that when the adapter is applied to a plug receptacle which is formed with a ground terminal hole and provided with a pair of power terminal holes which are selectively closed with a lid member, said push pin displaces said lid member from said power terminal holes of the plug receptacle.

16. An adapter as defined in claim 12, wherein said subadapter body is provided with a push pin so that when the adapter is applied to a plug receptacle which is formed with a ground terminal hole and provided with a pair of power terminal holes which are selectively closed with a lid member, said push pin displaces said lid member from said power terminal holes of the plug receptacle.

17. An adapter as defined in claim 9, wherein said second power terminal holes of said subadapter body are each formed with a cylindrical configuration having a substantially trapezoid shape in cross section;

said second power terminal holes are arranged on said subadapter body so as to be juxtaposed to each other and so that a top side of the trapezoid shape thereof faces outside of said subadapter body; and said second terminal contacts received in said second power terminal holes of said subadapter body each include a pair of second raised side walls arranged in a manner to define both oblique sides of a trapezoid and be in conformity to the trapezoid shape in cross section of each of said second power terminal holes of said subadapter body.

18. An adapter as defined in claim 11, wherein said second power terminal holes of said subadapter body are each formed with a cylindrical configuration having a substantially trapezoid shape in cross section;

said second power terminal holes are arranged on said subadapter body so as to be juxtaposed to each other and so that a top side of the trapezoid shape thereof faces outside of said subadapter body; and said second terminal contacts received in said second power terminal holes of said subadapter body each include a pair of second raised side walls arranged in a manner to define both oblique sides of a trapezoid and be in conformity to the trapezoid shape in cross section of each of said second power terminal holes of said subadapter body.

19. An adapter as defined in claim 13, wherein said second power terminal holes of said subadapter body are each formed with a cylindrical configuration having a substantially trapezoid shape in cross section;

said second power terminal holes are arranged on said subadapter body so as to be juxtaposed to each other and so that a top side of the trapezoid shape thereof faces outside of said subadapter body; and said second terminal contacts received in said second power terminal holes of said subadapter body each include a pair of second raised side walls arranged in a manner to define both oblique sides of a trapezoid and be in conformity to the trapezoid shape in cross section of each of said second power terminal holes of said subadapter body.

20. An adapter as defined in claim 15, wherein said second power terminal holes of said subadapter body are each formed with a cylindrical configuration having a substantially trapezoid shape in cross section;

said second power terminal holes are arranged on said subadapter body so as to be juxtaposed to each other and so that a top side of the trapezoid shape thereof faces outside of said subadapter body; and said second terminal contacts received in said second power terminal holes of said subadapter body each include a pair of second raised side walls arranged in a manner to define both oblique sides of a trapezoid and be in conformity to the trapezoid shape in cross section of each of said second power terminal holes of said subadapter body.

21. A universal adapter for a plug receptacle, comprising:

a pair of adapter bodies made of an insulating material and having a respective oblong configuration;

means for providing a pivoting connection adjacent one end of each adapter body;

a cylindrical plug terminal provided adjacent the other end of each adapter body;

a pair of power terminal holes for a plug receptacle provided in one of the adapter bodies and configured with substantially trapezoid shapes in a cross-section;

a pair of terminal contacts, mounted respectively in the power terminal holes and arrange to electrically contact either a cylindrical or flat plug terminal; and means for electrically connecting the respective terminal contact with a corresponding plug terminal, whereby the plug terminals can be moved to accommodate different plug receptacles.

* * * * *